US006482065B1

(12) United States Patent
Blackman

(10) Patent No.: US 6,482,065 B1
(45) Date of Patent: Nov. 19, 2002

(54) INFLATABLE OBJECT THAT CONTAINS A MODULE THAT IS INACCESSIBLE FROM THE OUTSIDE BUT WHICH BECOMES POWERED IN RESPONSE TO INFLATION OF THE OBJECT

(76) Inventor: John A. Blackman, 207 Booth Ave., Englewood, NJ (US) 07632

( * ) Notice: Subject to any disclaimer, the term of this patent is extended or adjusted under 35 U.S.C. 154(b) by 0 days.

(21) Appl. No.: 09/522,123

(22) Filed: Mar. 9, 2000

(51) Int. Cl.[7] ..... A63H 3/06; F21V 33/00
(52) U.S. Cl. ..... 446/220; 362/96
(58) Field of Search ..... 446/220–226; 362/806, 253, 802, 96

(56) References Cited

U.S. PATENT DOCUMENTS 3,740,543 A * 6/1973 Franc ..... 362/157
4,464,861 A * 8/1984 Fogarty et al. ..... 446/175
4,704,934 A * 11/1987 Nosrati ..... 428/12
5,054,778 A * 10/1991 Maleyko ..... 273/DIG. 8
5,108,338 A * 4/1992 Margolis ..... 446/220
5,215,492 A * 6/1993 Kubiatowicz ..... 362/253
5,609,411 A * 3/1997 Wang ..... 362/234
5,669,702 A * 9/1997 Wang ..... 362/234
5,725,445 A * 3/1998 Kennedy et al. ..... 473/570
5,782,668 A * 7/1998 Chabert ..... 446/220
6,238,067 B1 * 5/2001 Hirsch ..... 362/231

* cited by examiner

*Primary Examiner*—Jacob K. Ackun
*Assistant Examiner*—Faye Francis
(74) *Attorney, Agent, or Firm*—Gibbons, Del Deo, Dolan, Griffinger & Vecchione

(57) ABSTRACT

An inflatable object including an electronic module with a voice/music chip or an illumination device and at least one battery within confines of the inflatable object, an insulator being configured and arranged in a disabling position to prevent powering of the electronic module by the at least one battery, and an end of the insulator being secured to an inside surface of the inflatable object so that as opposite sides of the inflatable object spread apart in response to inflation of the inflatable object, forces are imposed on the insulating tab to force the insulating end to leave the disabling position to permit powering of the electronic module by the at least one battery.

15 Claims, 7 Drawing Sheets

INFLATABLE OBJECT THAT CONTAINS A MODULE THAT IS INACCESSIBLE FROM THE OUTSIDE BUT WHICH BECOMES POWERED IN RESPONSE TO INFLATION OF THE OBJECT

CROSS-REFERENCE TO RELATED PATENT APPLICATIONS

Ser. No. 09/223,920, "Acoustic Transducer: A Piezoelectric Buzzer on an Inflated Object," currently pending.

Ser. No. 09/301,800, "Sound Generator: A Piezoelectric Buzzer on a Flexible, Tensioned Surface or an Inflatable Object," currently pending.

STATEMENT REGARDING FEDERALLY SPONSORED RESEARCH OR DEVELOPMENT

Not Applicable.

BACKGROUND OF THE INVENTION

1. Field of the Invention

The present invention relates to an inflatable object that contains a module that is inaccessible from the outside but becomes powered in response to inflation of the item. The module, when powered and triggered, may generate sounds or illuminate lights or the like.

2. Discussion of the Related Art

Inflatable objects, such as balloons, have been equipped with electronic modules that generate sounds. If the electronic module is arranged within the inflatable object, it may draw power from button cell batteries, even if inadvertently triggered during transit. This drain on the power diminishes the life of the batteries.

Button cell batteries have a limited life so various power conserving techniques may be employed to decrease the rate at which the battery power is drained. Nevertheless, draining the battery power inadvertently prior to inflation of the inflatable object should be avoided to maximize battery life.

What is needed is an inflatable object equipped internally with an electronic module that minimizes the drain of battery power at least until the inflatable object becomes inflated.

BRIEF SUMMARY OF THE INVENTION

One aspect of the invention resides in an apparatus and method that prevents draining of batteries. The apparatus includes an inflatable object, an electronic module and at least one battery being arranged within the inflatable object, an insulator being configured and arranged in a disabling position to prevent powering of the electronic module by the at least one battery. An end of the insulator is secured to an inside surface of the inflatable object so that as opposite sides of the inflatable object spread apart in response to inflation of the inflatable object, the module may be energized.

The method includes the steps of arranging and securing an electronic module to an inside surface of an inflatable object; positioning an insulator in a disabling position that is between the electronic module and at least one battery to electrically insulate the battery(ies) from the circuit of the electronic module; and securing an end of the insulator to an inside surface of the inflatable object so that as opposite sides of the inflatable object spread apart in response to inflation of the inflatable object, forces are imposed on the insulator to force the insulator to leave the disabling position, allowing the circuit and module to be energized if desired.

BRIEF DESCRIPTION OF THE DRAWINGS

For a better understanding of the present invention, reference is made to the following description and accompanying drawings, while the scope of the invention is set forth in the appended claims.

DETAILED DESCRIPTION OF THE INVENTION

Figure 1:
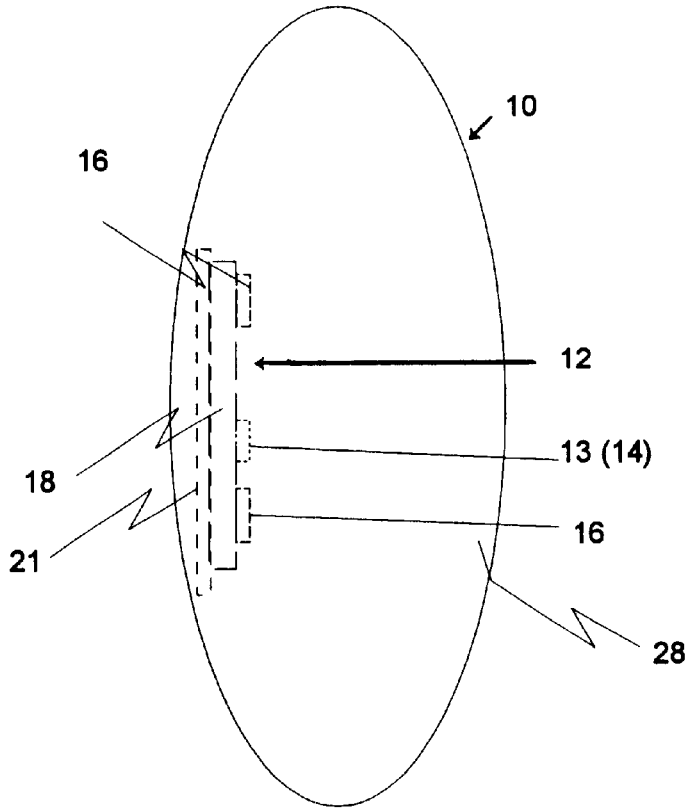
FIG. 1 is a schematic representation of the present invention within an inflatable object.

Turning to FIG. 1, one side of an inflatable object 10 is shown containing an electronic module 12. The inflatable object 10 is exemplified by a balloon and preferably has a metallized skin (e.g. Mylar), such as made of metallized nylon film material. The inflatable object 10 is inflated through a conventional inlet valve (not shown) to be filled with a gas such as air or a lighter than air gas such as helium.

The electronic module 12 may include a conventional printed circuit board (PCB) 18 with a conventional voice/music melody chip 13 or illumination device 14 (e.g. a bulb, LED etc. shown in FIG. 1), at least one conventional button cell battery 16 and other conventional electronic components and conductors necessary to render operative a chip 13 or illumination device 14. The module 12 may be mounted to an inside surface of an inflatable object 10. The module 12 may include a piezoelectric buzzer 21 which produces the sound. When a piezoelectric buzzer 21 is used it would be mounted to the inside surface of an inflatable object 10. If an illumination device 14 is used, as exemplified by light emitting diodes, this could, if desired, eliminate the need for piezoelectric buzzer 21 and chip 13.

An insulator in the form of an insulating tab 24 (FIG. 2) is configured and arranged to disable powering of the electronic module 12 and thereby prevent the draining of the button cell battery 16 as may otherwise arise from false triggering or other unintended battery drain before the inflatable object 10 is inflated.

An insulating end of insulating tab 24 (FIG. 2) is located between the at least one button cell battery 16 and a terminal contact 26 that leads to PCP 18 prior to inflation of the inflatable object 10. In such a location, the end of the insulating tab 24 is in a disabling position, because it is configured to electrically insulate the button cell battery 16 against establishing electrical contact with the terminal contacts 26 on the printed circuit board 18, thereby preventing powering of the electronic module 12. A spring bias contact 22 exerts bias against the battery 16 urging it into contact with terminal 26.

Figure 2:
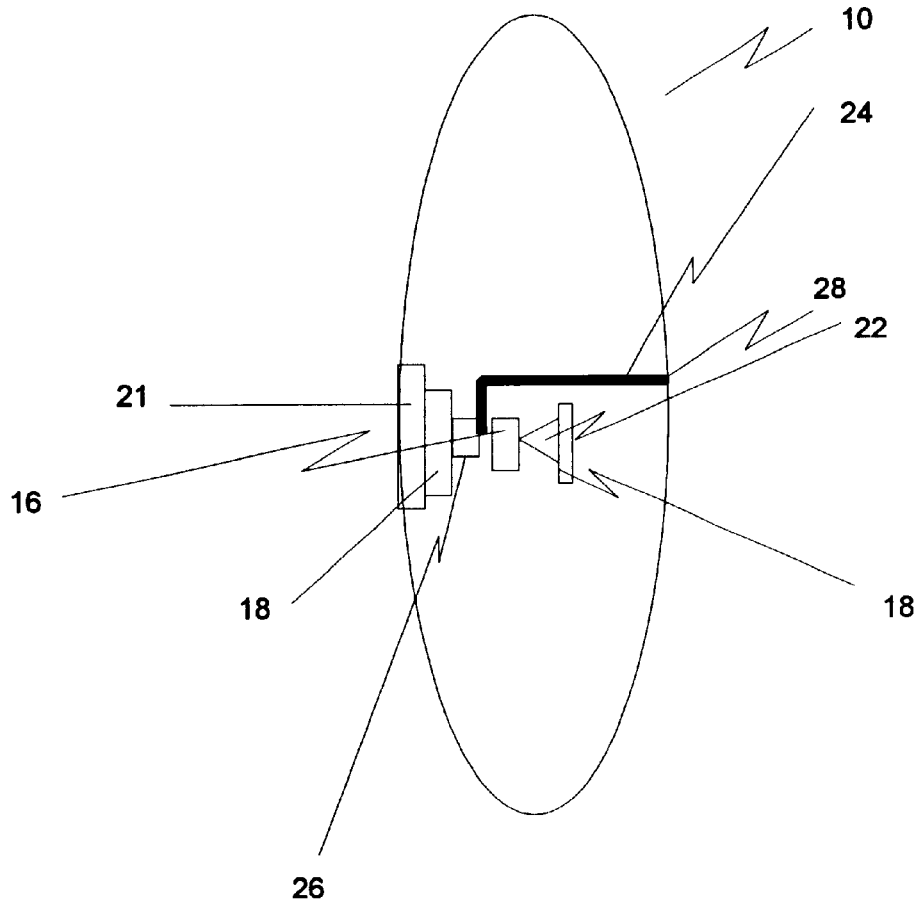
FIG. 2 is a schematic representation of the present invention in an inflatable object before inflation.

Referring to FIG. 2, the other end of insulating tab 24 is bonded or otherwise attached to an attachment area 28. The attachment area 28 is on an inside surface of sheath or skin of that inflatable object 10 and at a location that is at an opposite side from the side of the inflatable object where the end of the insulating tab 24 is located in the disabling position.

As the inflatable object 10 inflates the opposite sides of the inflatable object 10 spread apart. As the sides spread apart, pulling forces arise that act on the insulating tab 24 at the attachment location 28 to separate the insulating tab 24 from the electronic module 12, thereby causing the insulating tab 24 to leave the disabling position and enter into a non-disabling position. Once the insulating tab 24 leaves the disabling position, the spring bias contact 22 exerts spring bias against the battery 16. The battery 16 is forced to electrically engage the terminal contacts 26 to render the electronic module 12 ready to be triggered.

Once the battery 16 makes electrical connection with both contacts 22, 26, an electrical circuit through the printed circuit board closes, powering the electronic module 12, and allowing the module 12 to be energized when triggered.

The chip 13 may generate acoustic signals continuously or periodically in response to becoming actuated by an electronic trigger after the insulating tab 24 leaves the disabling position. In addition or alternatively, the chip 13 may be actuated by any conventional means, including, but not limited to, a touch or motion sensor or in response to detection and termination of external sounds or light frequencies. In addition or alternatively, the chip 13 may be actuated or triggered by flexing the piezoelectric buzzer 21. In the same manner, if an illumination device 14 is used, it may be illuminate lights either continuously or periodically in response to being actuated, whether by an electronic trigger or by conventional means.

The piezoelectric buzzer 21 responds to the acoustic signals by converting the signals into sounds and enunciating the same, thereby serving as a speaker. The sounds resonate off the interior walls of the inflatable object 10, generating amplified sounds corresponding to the voice/music. The sounds project or amplify in magnitude due to their resignation off the interior walls of the inflatable object 10. If an illuminating device 14 is used, the device 14 responds to the illuminating signals to convert them into light by illuminating light emitting diodes or other types of light sources.

The inflatable object 10 may be any object able to be inflated, including but not limited to, balloons, vinyl inflatables (such as those that appear as enlarged familiar objects such as beer bottles and soda cans), rafts, air pillows, air cushions, blow-up furniture items such as chairs, and any inflatable products such as balls, tires, blow-up toys, flotation toys, and blimps.

The insulating tab 24 may be any type of insulator that electrically insulates to prevent the drawing of power from the batteries 16 when situated between the battery contacts and terminal contacts 26. It is, of course, to be appreciated that insulating tab 24 can be located at any appropriate place in the circuit.

FIG. 2 shows that the insulating tab 24 has an L-shape. However, the insulating tab 24 is flexible so that when pulled out from between the contacts of the battery 16 and the contact 26 of the printed circuit board 18, it need not retain the L-shape, but rather freely bends.

Figure 3:
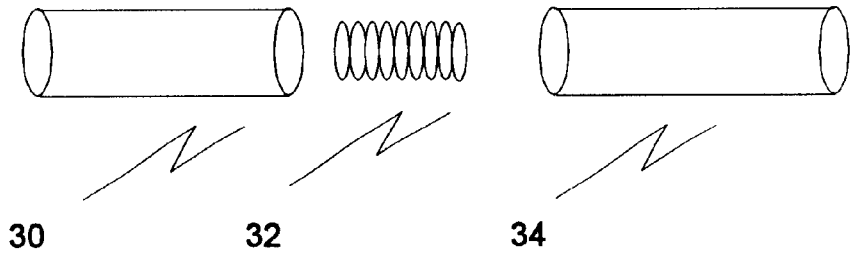
FIG. 3 is a schematic representation of a "spring trigger" embodiment.
Figure 4:
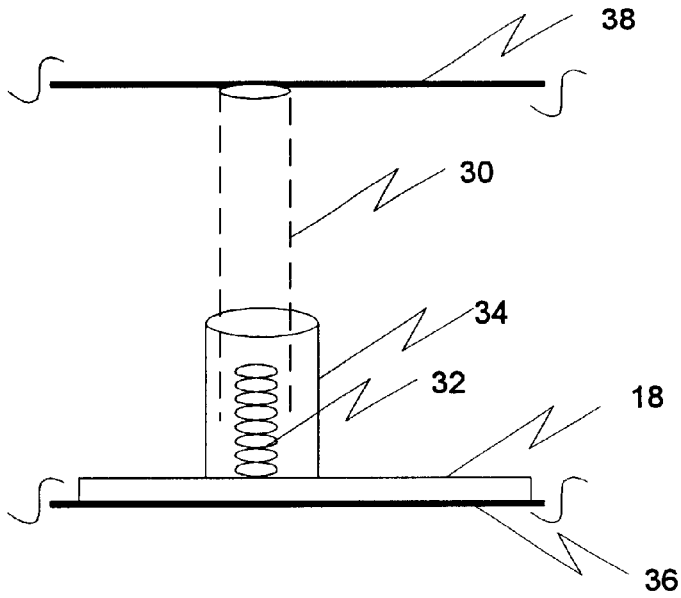
FIG. 4 is a schematic representation of a "spring trigger" embodiment in a vertical mount.
Figure 5:
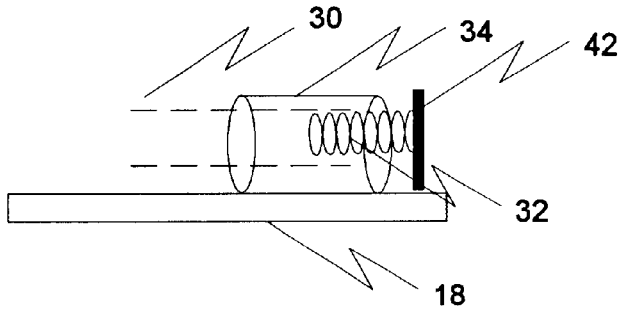
FIG. 5 is a schematic representation of a "spring trigger" embodiment in a horizontal mount.

FIGS. 3–7 show various embodiments of triggering. In the case of FIG. 3, the insulating tab 24 of FIG. 2 is replaced by a combination of a plastic insulating straw 30, spring 32 and conductive metal tube 34. The combination of FIG. 3 may be mounted vertically as represented in FIG. 4 or horizontally as represented in FIG. 5.

In each of the embodiments of FIGS. 3–7, the straw 30 is disposed initially enclosing the spring 32 and insulating electrically from the conductive metal tube 34. Upon inflation of the balloon 10, the straw 30 moves with a balloon wall allowing spring 32 to contact metal tube 34 (FIG. 3). Once clear, the spring 32 jostles into contact with the tube 34. This jostling may be in response to movement of the balloon and in effect acts as a motion sensor switch, thereby creating an electrical connection from a fixed end of the spring 32 to the conductive metal tube 34.

In the case of FIG. 4, the conductive metal tube 34 is fixed mechanically to the printed circuit board 18, which in turn is connected to one inner side of the balloon film 10 (FIG. 2). The straw 30 is bonded to the opposite inner side 38 of the balloon film 10 (FIG. 1). The spring 32 is a fixed attachment mechanically and made of an electrically conductive material. Prior to inflation, the straw 30 is located between the conductive metal tube 34 and the spring 32. The straw 30 serves as an insulator between the two. As a result, the battery 16 (not shown in FIGS. 3–7) is prevented from powering the printed circuit board 18. As the balloon 10 is inflated, the straw 30 moves in unison with the opposite inner side 38 of the balloon film 10 (FIG. 1) and away from the printed circuit board 18 allowing the spring 32 to contact the conductive metal tube 34.

In the case of FIG. 5, a mounting bracket 42 is provided for attachment of the spring 32 to the printed circuit board 18 both mechanically and electrically. As the balloon 10 inflates, a straw insulator 30 no longer prevents energizing of the electronic module 12.

Figure 6:
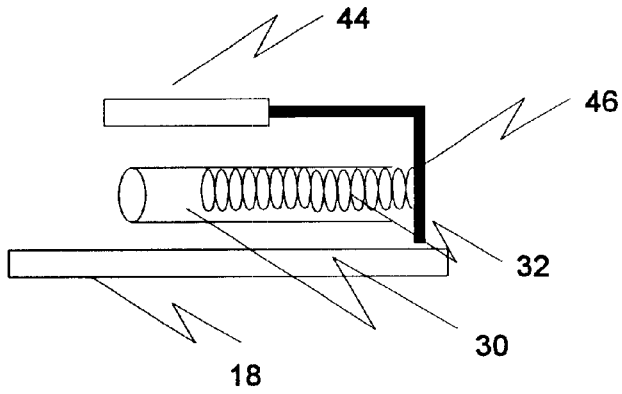
FIGS. 6 and 7 are schematic representations of a metal plate mounted spring trigger embodiment.

FIG. 6 is the same as the embodiment of FIG. 5 as concerns its operation, except that the tube 34 of FIG. 5 is replaced by a metal contact plate 44 and L-shaped bracket 46 attached to the printed circuit board 18. The straw 30 serves as an electrical insulator between the spring 32 and the contact plate 44. Although an end of the spring 32 is shown fixed to the L-shaped bracket 46, no electrical connection is made with the contact plate 44. Two separate conductors (not shown) extend from the printed circuit board and along the L-shaped bracket 46. Only one of those conductors is in electrical contact with the fixed end of the spring 32. The other conductor is in electrical contact with the contact plate 44.

Figure 7:
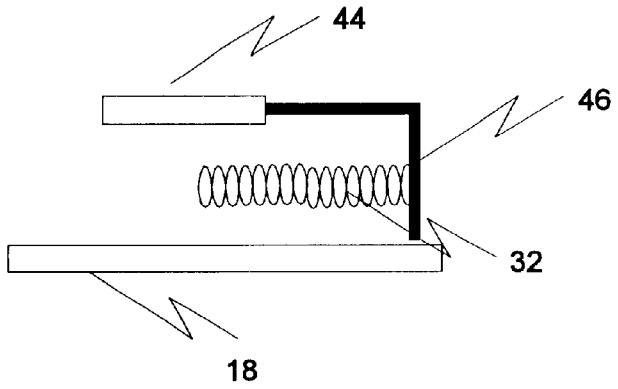

FIG. 7 is the same as the embodiment of FIG. 6 except showing the result after the insulating straw 30 (FIG. 6) is withdrawn from its position in FIG. 6 of being disposed between the contact plate 44 and the spring 32. During inflation, the straw 30 (FIG. 6), which is attached to an opposite film end of the balloon 10, moves in unison with the opposite film end in a manner analogous to the embodiment of FIG. 4 to reach a position clear of being located between the spring 32 and the contact plate 44 to permit the spring 32 to move to effect electrical connection (even if only momentary) with the contact plate 44 to serve as a trigger for the circuit.

While the invention has been described with respect to certain specific embodiments, it will be appreciated that many modifications and changes may be made by those skilled in the art without departing from the invention. It is intended, therefore, by the appended claims to cover all such modifications and changes as may fall within the true spirit and scope of the invention.

What is claimed is:

1. An apparatus that prevents drainage of power, comprising:

an inflatable object;

an electronic module and at least one battery within confines of the inflatable object;

an insulator being configured and arranged in a disabling position to electrically insulate and prevent powering of the electronic module by the at least one battery, the insulator having an end secured to an inside surface of the inflatable object, the insulator being arranged to leave the disabling position in response to opposite sides of the inflatable object spreading apart from each other due to inflation of the inflatable object; and electrical contacts making electrical connection in response to the insulator leaving the disabling position to enable powering of the electronic module by the at least one battery.

2. An apparatus as in claim 1, wherein said electronic module includes a voice/music melody chip, which is configured and arranged to respond to acoustic signals being generated by said electronic module to generate audible sounds.

3. An apparatus as in claim 2, wherein the electronic module comprises a printed circuit board and a voice/music melody chip.

4. An apparatus as in claim 1, wherein the electronic module includes an illuminating device, which is configured and arranged to respond to illumination signals being generated by said electronic module to generate light.

5. An apparatus as in claim 1, further comprising a spring bias that is situated between electronic module and the at least one battery and arranged to apply pressure that sandwiches the insulator between the electrical contacts so that in response to the insulator leaving the disabling position, the electrical contacts make the electrical connection.

6. An apparatus as in claim 5, wherein the electrical contacts are arranged on the at least one battery and the electronic module.

7. An apparatus as in claim 6, further comprising a conductive surface and a spring, the insulator being between the conductive surface and the spring as the insulator remains in the disabling position, the conductive surface and the spring being the electrical contacts, the spring being arranged to jostle into contact with the conductive surface after the insulator leaves the disabling condition.

8. A method of preventing drainage of at least one battery in an inflatable object including an electronic module, comprising the steps of:

arranging the electronic module and at least one battery within the inflatable object;

positioning an insulator in a position to electrically insulate the electronic module from the at least one battery;

securing an end of the insulator to an inside surface of the inflatable object; and arranging electrical contacts to make electrical connection between the at least one battery and the electronic module in response to the insulator leaving the disabling position as opposite walls of the inflatable object spread apart.

9. A method as in claim 8, further comprising sandwiching the insulator between the electrical contacts under pressure.

10. A method as in claim 8, further comprising triggering the electronic module while the electronic module is being powered by the at least one battery; and generating sounds in response to the triggering of the electronic module.

11. A method as in claim 8, further comprising triggering the electronic module while the electronic module is being powered by the at least one battery; and illuminating lights in response to triggering of the electronic module.

12. A method as in claim 9, wherein the sandwiching arises from a spring bias imposed on the at least one battery against the insulator to sandwich the insulator between the at least one battery and the electronic module, the electrical contacts being on the at least one battery and the electronic module.

13. A method as in claim 8, where in response to the insulator leaving the disabling position, a movement of the electrical contacts results in the electrical connection becoming effected.

14. An apparatus that prevents drainage of power in an inflatable balloon including an electronic module, comprising:

an inflatable balloon;

an electronic module and at least one battery within confines of the inflatable balloon;

an actuatable switch being entirely within the confines of the inflatable balloon, mechanically actuatable and configured and arranged to actuate powering of the electronic module by the at least one battery in response to the inflatable balloon spreading apart during inflation;

an insulator being configured and arranged to insulate the actuatable switch against actuating the powering while the insulator is in a disabling position, the insulator being configured and arranged to move from and clear of the disabling position in response to the opposite sides of the inflatable object spreading apart during inflation of the inflatable object thereby freeing the trigger to effect the actuating of the powering.

15. An apparatus as in claim 14, wherein the trigger includes an electrically conductive contact surface and a spring, the insulator being sandwiched between the spring and the contact surface while in the disabling position, the spring being configured and arranged to move in response to the insulator clearing the disabling position to make electrical contact with the surface, the electronic module being powered by the at least one battery is response to the electrical contact having been made.

* * * * *